US007267456B1

(12) United States Patent
Holmes

(10) Patent No.: US 7,267,456 B1
(45) Date of Patent: Sep. 11, 2007

(54) OPERATING STATUS OF A SHUTTER FOR ELECTROMAGNETIC ENERGY CURING SYSTEMS

(75) Inventor: Mark Holmes, Waterford, CT (US)

(73) Assignee: Henkel Corporation, Rocky Hill, CT (US)

( * ) Notice: Subject to any disclaimer, the term of this patent is extended or adjusted under 35 U.S.C. 154(b) by 315 days.

(21) Appl. No.: 11/036,342

(22) Filed: Jan. 14, 2005

(51) Int. Cl.
*F21V 33/00* (2006.01)

(52) U.S. Cl. ..... 362/276; 362/318; 250/372

(58) Field of Classification Search ..... 362/276, 362/802, 318; 250/372, 358.1, 306
See application file for complete search history.

(56) References Cited

U.S. PATENT DOCUMENTS 4,025,795 A * 5/1977 Lackore et al. ..... 250/504 R
4,644,899 A * 2/1987 Glaus ..... 118/642
5,444,814 A * 8/1995 Hofius, Sr. ..... 392/407
5,722,761 A * 3/1998 Knight ..... 362/96
6,874,249 B2 * 4/2005 Holmes ..... 34/275

* cited by examiner

*Primary Examiner*—Ali Alavi
(74) *Attorney, Agent, or Firm*—Steven C. Bauman

(57) ABSTRACT

The present invention provides a method and system for detecting operating status of the shutter. The device includes a shutter for receiving a light from a source, a solenoid for controlling movement of the shutter, and an optical sensor connected to the shutter for detecting the light received by the shutter. The solenoid produces a electrical signal indicating the solenoid operating state signal. The sensor produces electrical signal indicating open and closed stages of the shutter. The device further includes an electronic circuit for receiving both the electrical signals, and outputting an electrical output signal reflecting the operating status of the shutter.

20 Claims, 2 Drawing Sheets

SOLENOID STUCK IN UP POSITION

SOLENOID STUCK IN UP POSITION

SHUTTER STUCK IN UP POSITION

SHUTTER STUCK IN UP POSITION

SHUTTER JAMMED CLOSED

SHUTTER JAMMED CLOSED

OPERATING STATUS OF A SHUTTER FOR ELECTROMAGNETIC ENERGY CURING SYSTEMS

BACKGROUND OF THE INVENTION

1. Field of the Invention

The present invention relates generally to electromagnetic energy curing systems and more particularly to an ultraviolet curing device adapted to determine operating status of a shutter in light cure wand systems.

2. Brief Description of Related Technology

The use of ultraviolet radiation for curing inks, coatings, adhesives and other types of compounds is well known. In recognition of the many advantages attendant to the use of ultraviolet curing, various known ultraviolet curing systems have been developed for use in adhesive bonding applications such as medical device assembly, electronic assembly, conformal coating rework, wire tacking, potting and sealing, fiberoptic splicing, glass and crystal bonding, and stereo lithography.

One known ultraviolet curing system which is representative of many such systems currently available in the marketplace is manufactured by Henkel Corporation and sold under the trade name "Loctite Light Cure Wand Systems". This particular device generally comprises a housing which is adapted to be placed upon a support surface such as a counter top and includes miniature arc lamp disposed therewithin for providing a source of ultraviolet light. Also disposed within the housing is a power supply which is electrically interfaced to the lamp and to a fan which is attached to the housing and adapted to circulate air therethrough to cool the lamp during its operation. Releasably attached to the housing is one end of an elongate, flexible wand which is liquid filled and adapted to transmit the ultraviolet light from the light source to an ultraviolet curable compound proximate the distal end of the wand. In the wand, liquid is used as the ultraviolet transmission medium since other transmission mediums such as optical fibers are less efficient.

Disposed between the arc lamp and the end of the wand attached to the housing is a mechanical shutter mechanism which is selectively actuatable between open and closed positions by a solenoid which is mechanically coupled thereto and electrically interfaced to the power supply. The actuation of the shutter mechanism to the open position facilities the transmission of ultraviolet light from the lamp into the wand, while the actuation of the shutter mechanism to the closed position blocks such transmission.

Though this system is generally sufficient for exposing an ultraviolet curable composition to ultraviolet light for purposes of curing the composition, these systems require a means to determine and respond to malfunctioning of the shutter for safety purposes. In other words, the system needs to determine if the shutter is an unintended open or closed state. An unintended open state of the shutter can result in very high intensity UV light up to 25 W/cm$^{2}$ being irradiated. Alternatively, an unintended closed state can result in an uncured or insufficiently cured product. Additionally, it is required that the system respond to such unintended states of the shutter and further take additional measures for its protection.

SUMMARY OF THE INVENTION

The present invention provides an apparatus and a method for determining operating status of the shutter. The method includes providing a first electrical signal reflecting an operating state of a solenoid, wherein the solenoid controls the movement of the shutter. The method further includes the shutter receiving a beam of light from a source, wherein the light is detected to determine open and closed stages of the shutter. A second electrical signal is provided reflecting the open and closed stages of the shutter. Finally, an electrical output signal is produced upon receipt of the first and second electrical signals, wherein the electrical output signal is indicative of the operating status of the shutter.

DETAILED DESCRIPTION OF THE INVENTION

The subject invention relates to a shutter malfunction safety interlock, preferably for photocuring with wand systems. In a preferred embodiment, the mechanism is an electromechanically controlled shutter that is interposed between a source of radiation and sensor. The failure of the shutter is determined by the logic gate upon receipt of the electrical output signal of the sensor and a solenoid. The system utilizes a source of radiation found in electromagnetic energy, such as ultraviolet light (UV), visible light (VIS) and infrared. To describe the invention and illustrate its functioning, reference is made herein to the UV light, however, it is understood that the UV light can be interchanged with other types of electromagnetic energy.

Figure 1:
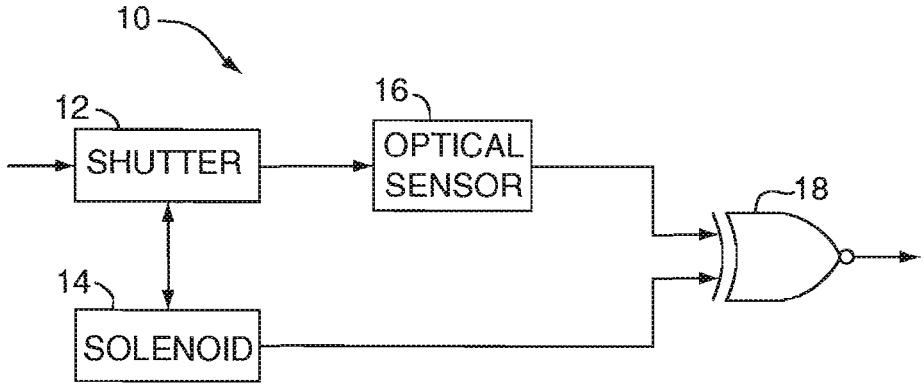
FIG. 1 is a schematic block diagram illustrating the determining of the operating status of the shutter according to the present invention.

Referring to FIG. 1, there is shown a schematic block circuit diagram 10 of determining operating status of the shutter according to the present invention. Specifically, the diagram of FIG. 1 is capable of providing an electrical output signal reflecting the open and closed status of the shutter 12. The movement of the shutter 12 is controlled by a solenoid 14 which is preferably coupled to the shutter 12. An optical sensor 16 is provided, which is connected to the shutter 12, for detecting and/or receiving the UV radiation. Additionally, a logic gate, preferably an exclusive NOR or XNOR gate 18, is provided to receive the signals from the solenoid 14 and the sensor 16, which in turn produces an output signal indicating any failure of the shutter 12.

As known in the field of digital electronics, there are usually two states possible at any point, i.e., high (H) or low (L) states. Relatively, these states refer to voltage associated with a signal. Usually these two state signals are used to turn a device on and off. In digital circuitry, the voltage levels corresponding to high and low are allowed to fall in some range. So the high (H) state voltage must be high enough in the range to turn on the device and the low (L) state voltage must be below the range for the device to be off.

Figure 2A:
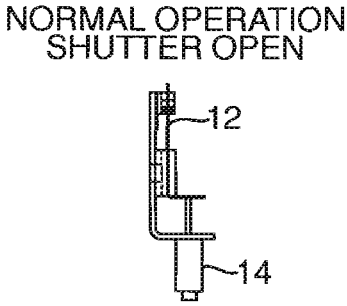
FIGS. 2A-2D illustrate portions of shutter/solenoid during normal operation.

In one embodiment of the present invention light, preferably ultraviolet light, is provided from a source, such as a ballast lamp (not shown). When the light beam reaches the shutter 12, the shutter 12 preferably may be operating in either an open or closed positions. During normal operation, when the shutter is open, i.e. in the up position as shown in FIG. 2A, the light beam from the source to the sensor 16 is broken. Since no light reaches the sensor 16, the sensor 16 remains in the off mode, thereby producing a low (L) output state. The state of the solenoid operating signal at that time is high (H) due to solenoid being activated. Thus, when solenoid 14 is activated or energized, it moves the shutter 12 such that the circular hole of the shutter 12 is not aligned with the sensor 16. In this position, the lightbeam from the source to the sensor 16 is broken thereby preventing the light beam from the source to reaching the product to be cured.

Both the output signals of the sensor 16 and the shutter 12 are fed to the XNOR gate 18. As well known in the art, XNOR is a logic gate that provides an output signal that is high (H) if either, both input and output, signals are high (H) or both input signals are low (L). Otherwise, the output signal of the XNOR gate is low (L). So the L signal from the sensor 16 and the H signal from the solenoid 14 is fed to the XNOR gate 18. Therefore, the output of the XWOR gate 18 is L indicating that the shutter 12 is operating normally.

Figure 2B:
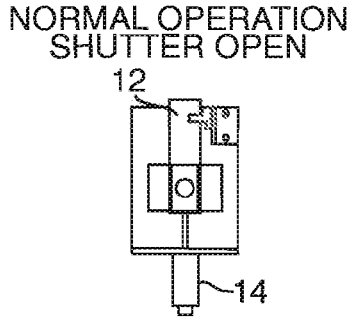
Figure 2C:
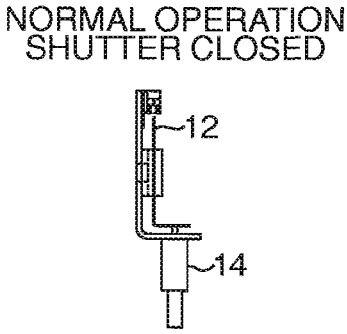
Figure 2D:
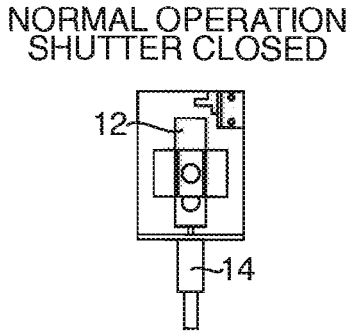

Conversely, when the shutter 12 is closed during normal operating i.e. the shutter is down as shown in FIG. 2B, the light from the source reaches the sensor 16. As soon as the sensor 16 detects light, the sensor turns on and the output of the optical sensor 16 is H. In the closed position, shutter is in a position wherein the circular hole of the shutter 12 is coincided or aligned with the sensor 16. In this position, the lightbeam from the source is made to pass through the opening of the shutter 12 to the sensor 16, thereby allowing the light beam from the source to reach the product to be cured. Again, both the output signals of the sensor 16 which is H, and the solenoid which is L, are fed to an XNOR logic gate 18. The output of the XNOR gate 18 is L, indicating that the shutter 12 is operating normally.

As discussed above, during normal operation, i.e. shutter 12 is functioning normally, the output of the XNOR gate 18 is low (L). However, during the period of malfunctioning of either the shutter 12 and/or the solenoid 16, the XNOR gate 18 provides a desired output for all failure modes as described herein below.

Figure 3A:
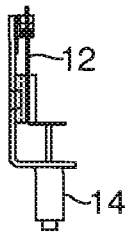
FIGS. 3A-3F illustrate various positions of shutter/solenoid during malfunction.
Figure 3B:
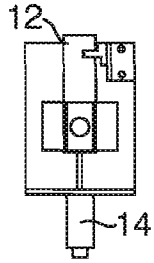
Figure 3C:
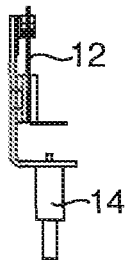
Figure 3D:
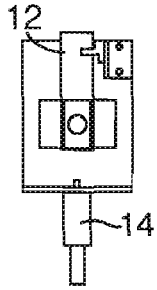
Figure 3E:
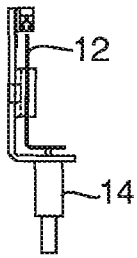
Figure 3F:
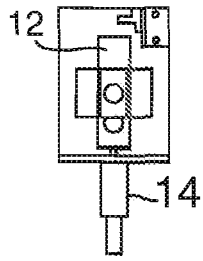

Referring to FIGS. 3A-3C, there is shown various positions when shutter 12 and/or solenoid 16 has failed. FIG. 3A shows when the solenoid 16 is stuck in the up position, the shutter 12 remains open. Since the shutter is in the up position, the light beam produced by the radiant source is prevented from reaching the sensor, thereby causing the output of the sensor 16 to be in the off state, (L). In this case, since both the sensor output and solenoid signal is low (L), the XNOR gate output is high (H). Similarly in FIG. 3B, when the shutter 12 becomes stuck in the open position, both the sensor output and the solenoid signal are L, so the gate output becomes H. On the other hand, as shown in FIG. 3C, the shutter 12 is stuck in a closed positioned. Since the light beam is received and detected by the sensor 16, it turns on. In this case, the solenoid is energized with H electrical state the sensor output is H, therefore, the gate output is H. The H signal from the XNOR gate 18 is a clear indication of the shutter/solenoid failure.

The H signal from the gate 18 can be used to turn off the lamp and/or perform other functions such as turn on a visual warning signal such as a LED signal, or other means such as an audible signal can be used to warn of the shutter failure.

Upon receipt of a warning signal, it will be required to disable the lamp. One such method is to use a relay to turn off the input power to the ballast. Some ballasts are available with terminals to remotely disable the ballast. In this case a relay or transistor can be utilized. In some cases it may be less complicated to simply use a transistor controlled by the logic gate output to short two points on the ballast control board that are known to disable the lamp. Alternatively, output from the XNOR gate 18 can also be used to disable the ballast in the event of a shutter failure. This can be done in a number of ways, including shutting off the gate on base signal (s) to switching MOSFET of bipolar transistor respectively off by disabling the oscillating circuit that provides the input pulses to the switching transistor.

The shutter 12 of the present invention is preferably made of sheet metal or plastic that is opaque to short wavelength UV. Other substances may be used, provided they are also opaque to short wavelength UV, and are not degraded by exposure to it.

In alternative embodiments different mechanisms for moving shutter 12 are used. For example, shutter 12 may be moved manually, without the use of solenoid 14. In yet other embodiments, different devices may be used to move shutter 12 to close and open positions. Stepping motors, electromagnets and other sources of mechanical power may be used to operate the shutter without departing from the scope of the present invention.

The sensor itself is preferably a photodiode that generates a current when irradiated with UV. Other electrical or electronic devices when electrical properties change are allowed within the scope of the invention.

The present invention provides several advantages in photocuring with wand systems. For instance, it prevents unexpected transmission of high intensity UV light from the photocuring units. It can also provide a visual or audible signal to indicate that the unit has malfunctioned. Specifically, the system in the present invention will respond if the shutter is in an unintended open or closed systems. An unintended open system can result in a safety issues since very high intensity UV light is being irradiated for example up to 25 w/cm^2. Whereas, an unintended closed state can result in system failure due to uncured product.

What is claimed is:

1. A system for determining an operating status of a shutter comprising:

a solenoid coupled to said shutter for controlling movement of said shutter, said solenoid outputting a solenoid operating state signal;

an optical sensor connected to the shutter for detecting light received from a source via the shutter, said sensor outputting sensor state signal indicative of open and closed stages of the shutter; and an XNOR logic gate coupled to receive said solenoid operating state signal and said sensor state signal, wherein said gate outputs a gate signal indicating the operating status of the shutter.

2. The system of claim 1 wherein the shutter is open when the sensor state signal is low.

3. The system of claim 1 wherein the shutter is closed when the sensor state signal is high.

4. The system of claim 1 wherein the operating status of the shutter is normal when the output gate signal is low.

5. The system of claim 1 wherein the operating status of the shutter has failed when the output gate signal is high.

6. The system of claim 5 wherein the failed operating status of the shutter includes shutter stuck in an open position.

7. The system of claim 5, wherein the failed operating status of the shutter includes shutter stuck in a closed position.

8. The system of claim 5 further includes a LED connected to the gate output to provide visual warning of the shutter failure.

9. The system of claim 5 further includes a transistor connected to the gate output for disabling the light source upon shutter failure.

10. The system of claim 1 wherein said solenoid is activated to control the movement of the shutter.

11. The system of claim 1 wherein said light includes UV light.

12. The system of claim 1 wherein said shutter is made of sheet metal.

13. The system of claim 1 wherein said shutter is made of plastic.

14. The system of claim 1 wherein said sensor is a photodiode generating a current when irradiated with UV light.

15. A method for determining an operating status of a shutter, said method comprising:

providing a first electrical signal reflecting an operating state of a solenoid; said solenoid controlling movement of the shutter;

receiving a beam of light from a source, wherein said light is received by said shutter;

detecting said light to determine open and closed stages of said shutter;

providing a second electrical signal reflecting the open and closed stages of said shutter;

producing an electrical output signal upon receipt of the first and second electrical signals, wherein said electrical output signal is indicative of the operating status of the shutter.

16. The method of claim 15 wherein the operating status of the shutter is normal when the electrical output signal is at a low state.

17. The method of claim 15 wherein the operating status of the shutter is failed when the electrical output signal is at a high state.

18. The method of claim 15 further includes sending a warning signal to the system upon shutter malfunction.

19. The method of claim 18 further includes disabling the light source upon receipt of the warning signal.

20. The method of claim 1 wherein said light is an UV light.

* * * * *